US011920600B2

(12) United States Patent
Philipp et al.

(10) Patent No.: US 11,920,600 B2
(45) Date of Patent: Mar. 5, 2024

(54) METHOD AND DEVICE FOR MAINTAINING A PUMPING SYSTEM IN OPERATIONAL CONDITION

(71) Applicant: SUEZ GROUPE, Paris la Defense (FR)

(72) Inventors: Patrick Philipp, Hayes (FR); Maurice Martaud, Triel sur Seine (FR); Pierre Gramont, Choisy Au Bac (FR)

(73) Assignee: SUEZ INTERNATIONAL, Paris la Défense (FR)

( * ) Notice: Subject to any disclaimer, the term of this patent is extended or adjusted under 35 U.S.C. 154(b) by 756 days.

(21) Appl. No.: 16/759,005

(22) PCT Filed: Oct. 23, 2018

(86) PCT No.: PCT/EP2018/079057
§ 371 (c)(1),
(2) Date: Apr. 24, 2020

(87) PCT Pub. No.: WO2019/081524
PCT Pub. Date: May 2, 2019

(65) Prior Publication Data

US 2020/0340483 A1 Oct. 29, 2020

(30) Foreign Application Priority Data

Oct. 25, 2017 (FR) ..... 1760073

(51) Int. Cl.
*F04D 15/00* (2006.01)
*F04D 13/06* (2006.01)

(52) U.S. Cl.
CPC ..... *F04D 15/0077* (2013.01); *F04D 13/06* (2013.01); *F04D 15/0088* (2013.01)

(58) Field of Classification Search
CPC .. F04D 15/0077; F04D 13/06; F04D 15/0088; F04D 7/04
See application file for complete search history.

(56) References Cited

U.S. PATENT DOCUMENTS 3,844,673 A 10/1974 Hayward
6,033,187 A * 3/2000 Addie ..... F04D 7/04 417/18

(Continued)

FOREIGN PATENT DOCUMENTS

CN 104866704 A 8/2015
CN 105466707 A 4/2016

(Continued)

OTHER PUBLICATIONS

Office Action issued in Chinese Patent Application No. 201880068734.X dated Dec. 1, 2021.

(Continued)

*Primary Examiner* — Dominick L Plakkoottam
(74) *Attorney, Agent, or Firm* — NIXON & VANDERHYE

(57) ABSTRACT

A method for maintaining a pumping system that is part of a pumping station in operational service, the pumping system including a pump, a motor driving the pump, and a pipe for discharging fluid by the pump, where the method includes at least the steps of measuring physical values that characterize the operational characteristics of the pumping system including hydraulic values characteristic of the state of the pump discharge pipe, analyzing and interpreting the measured physical values to detect one or more anomalies, pre-diagnosing probable causes of the detected anomalies, (Continued)

determining preventive and curative actions to apply to the pumping system, and automatically implementing the preventive and curative actions.

13 Claims, 4 Drawing Sheets

(56) References Cited

U.S. PATENT DOCUMENTS

| | | | | |
|---|---|---|---|---|
| 6,330,525 | B1 * | 12/2001 | Hays | F04D 15/0088 702/182 |
| 6,688,320 | B2 | 2/2004 | Frasure et al. | |
| 9,127,678 | B2 * | 9/2015 | Gomez | F04D 15/0088 |
| 2003/0060989 | A1 * | 3/2003 | Shigehara | F04D 27/001 702/50 |
| 2004/0267395 | A1 * | 12/2004 | Discenzo | H04L 67/12 702/182 |
| 2009/0125252 | A1 * | 5/2009 | Silovic | F04D 15/0088 702/116 |
| 2009/0204267 | A1 | 8/2009 | Sustaeta et al. | |
| 2012/0141301 | A1 * | 6/2012 | Van Der Spek | F04B 51/00 417/63 |
| 2013/0156606 | A1 * | 6/2013 | Orue Orue | A47L 15/0031 417/44.1 |
| 2013/0269817 | A1 * | 10/2013 | Okihara | E03B 5/00 138/39 |
| 2016/0076549 | A1 * | 3/2016 | Kelly | F04D 15/0066 700/282 |

FOREIGN PATENT DOCUMENTS

| | | | | |
|---|---|---|---|---|
| CN | 107013473 | A | 8/2017 | |
| CN | 206582134 | U | 10/2017 | |
| GB | 1343986 | A | 1/1974 | |
| WO | WO-2011036502 | A1 * | 3/2011 | B08B 9/0321 |

OTHER PUBLICATIONS

Office Action issued in European Patent Application No. 18 789 158.5 dated Oct. 27, 2022.

Office Action issued in Chinese Patent Application No. 201880068734.X dated Apr. 2, 2021.

International Search Report, dated Dec. 20, 2018, from corresponding PCT application No. PCT/EP2018/079057.

* cited by examiner

METHOD AND DEVICE FOR MAINTAINING A PUMPING SYSTEM IN OPERATIONAL CONDITION

TECHNICAL FIELD

The invention falls within the field of pumping such as, for example, urban hydraulic pumping that is used for collecting and conveying waste water, as well as for distributing water. More generally, the invention relates to the issues involved in managing water pumping stations comprising one or more pumping systems.

PRIOR ART—DESCRIPTION OF THE TECHNICAL PROBLEM

The field of managing pumping stations involves several types of participants each proposing a particular management service.

A first type of participant involves the pump manufacturers. These manufacturers benefit from detailed knowledge of the operation of their product and thus can precisely detect deviations in operation that could lead to pump breakdowns. However, the management systems proposed by the pump manufacturers are not, or are hardly, adapted to pumps originating from other manufacturers, neither is the pumping station as a whole, when it comprises a plurality of pumps from a different source and with a different form, for which several different parameters need to be monitored, such as hydraulic or electrical parameters.

A third type of participant involves the manufacturers of components used in the pumps and their motor. These components include roller bearings, seals, etc. Again, this type of participant is highly specialized in their technical field and, even if the systems that they propose will effectively detect a breakdown of the component, any breakdowns due to other components will not be detected.

A fourth type of participant involves service providers that will design generic tools for managing pumping stations. These tools take into account all the components of the pumps and the motors, but they must be correctly configured by an operator specializing in programming and with good knowledge of the systems forming the pumping station. The configuration of such tools requires knowledge that the electromechanical operators specializing in managing pumping stations do not have. Similarly, the operators specializing in configuring management tools do not have extensive knowledge of the operation of each item of equipment of the pumping station.

An aim of the invention is to particularly propose an automatic analysis tool for monitoring and analyzing the operation of the pumping station. This analysis tool also allows mechanical failures in the machines forming the pumping station to be detected, in particular the pumps and the motors. The analysis tool proposes a causal evaluation, as well as preventive and curative actions to be undertaken following the detection of one or more failures on the various components of the pumping station. If the actions do not require the intervention of an operator, the tool can transmit the suitable instructions to the pumping station.

SUMMARY OF THE INVENTION

To this end, the present invention proposes a method for keeping a pumping system forming part of a pumping station in operational condition. The pumping system particularly comprises a pump, a motor driving the pump, a pipe for discharging fluid via the pump, a pipe for sucking in fluid via the pump. The method comprises at least the following steps:

- measuring physical values characterizing the operation of the pumping system, including physical values characterizing the state of the discharge pipe of the pump, the state of the suction pipe of the pump;
- analyzing and interpreting measured physical values in order to detect one or more anomalies;
- pre-diagnosing probable causes of the detected anomalies and determining preventive and curative actions to be undertaken on the pumping system;
- automatically implementing preventive and curative actions on the pumping system.

The method can further comprise a step of analyzing and interpreting curves characterizing the operation of the suction and discharge pipes of the pump and a step of controlling the submersion of a water intake at the inlet of the pumping system.

The method particularly comprises a step of analyzing and interpreting the evolution of operating points of the pump and a step of analyzing and interpreting the evolution of operating points of the motor.

The method can also comprise a step of controlling the energy performance of the pumping system.

Said method can also comprise a step of detecting a cavitation phenomenon.

The step of controlling the submersion of the water intake can particularly take into account a water height in the water intake, a flow rate sucked in by the pump at the water intake, physical description parameters of the water intake.

The step of analyzing and interpreting the operation of the discharge pipe takes into account the evolution of the following parameters over time: a discharge pressure of the pump, a flow rate governed by the pump, a current intensity demanded from the motor, an active power demanded from the motor.

The step of analyzing and interpreting the operation of the suction pipe takes into account the evolution of the following parameters over time: an suction pressure of the pump, a flow rate governed by the pump, a current intensity demanded from the motor, an active power demanded from the motor, a total manometric height, an available NPSH.

The invention also relates to a device for keeping a pumping system forming part of a pumping station in operational condition. Said pumping system particularly comprises a pump, a motor driving the pump and at least one pipe for discharging and one pipe for sucking in fluid via the pump, said device being characterized in that it comprises:

- hydraulic and mechanical sensors taking measurements of hydraulic and mechanical values on the pump, the discharge pipe, the suction pipe;
- electrical and mechanical sensors taking measurements of electrical and mechanical values on the motor;
- an electrical cabinet for the pumping system collecting the measurements from the hydraulic, electrical and mechanical sensors, transmitting operating instructions to said pumping system;
- a monitoring system comprising a computer, on which a central program is executed implementing the method for keeping a pumping system in operational condition, said monitoring system being able to automatically transmit commands to the electrical cabinet as a function of the results from the analysis, interpretation and pre-diagnosis, said monitoring system comprising a human-machine interface for displaying the results of the analysis, the interpretation and the pre-diagnosis.

Advantageously, the invention allows automatic implementation of the suitable actions for preventing or resolving operating issues in the pumping station.

DESCRIPTION OF THE FIGURES

Further advantages and features of the invention will become apparent upon studying the detailed description of a plurality of non-limiting embodiments, and the accompanying drawings, in which.

With these embodiments being by no means limiting, alternative embodiments of the invention particularly can be considered that only comprise a selection of the features described or illustrated hereafter, isolated from the other features that are described or illustrated (even if this selection is isolated within a sentence comprising these other features), if this selection of features is enough to provide a technical advantage or to differentiate the invention from the prior art. This selection comprises at least one feature that preferably is operational, without structural details and/or, alternatively, with only part of the structural details, if this part alone is enough to provide a technical advantage or to differentiate the invention from the prior art.

DETAILED DESCRIPTION

Figure 1:
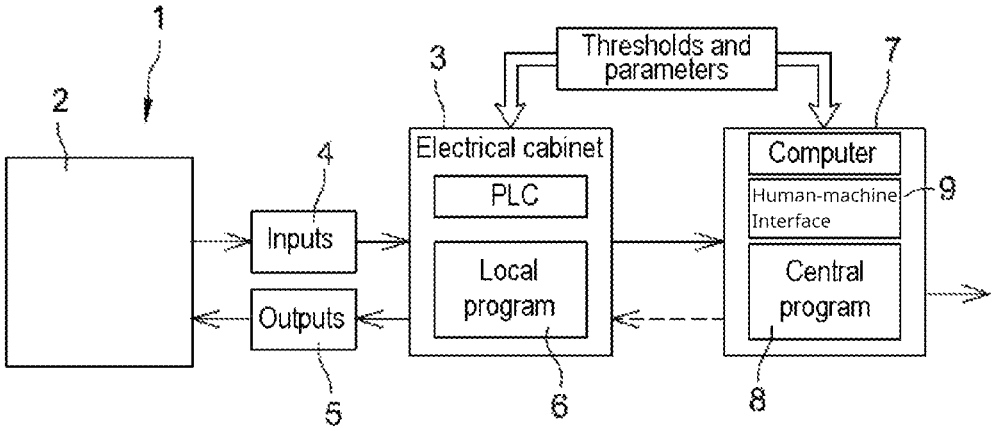
FIG. 1 depicts a simplified version of a pumping station according to the invention.

FIG. 1 depicts an example of a pumping station 1 comprising one or more pumping systems 2. The pumping system 2 comprises a pump, a motor, a water intake and a pump outlet pipe. The pumping system 2 can also comprise an inlet pipe connecting the pump to the water intake when the pump is not at least partly immersed in the fluid that it must pump. The pumping system 2 further comprises sensors 241 measuring parameters characterizing the operation of each component of the pumping system 2. Each pumping system 2 is connected to an electrical cabinet 3 intended to manage the pumping system 2. The purpose of the electrical cabinet 3 is to control and command the pumping system 2. The electrical cabinet 3 forms part of the pumping station 1. The electrical cabinet 3 receives the various measurements, or inputs 4, taken by the sensors 241 of the pumping system 2 and particularly transmits commands or outputs 5 to the pumping system 2. The electrical cabinet 3 comprises at least one processor, on which a local program 6 is executed for managing the operation of the pumping system 2. The inputs 4 are taken into account by the local program 6. The electrical cabinet 3 subsequently transmits the inputs 4 to be processed to a monitoring system 7. The monitoring system 7 can control and command one or more pumping stations. In order to simplify the disclosure, in the remainder of the description reference will be made to a pumping station. The monitoring system 7 is a remote server comprising at least one processor or computer, which implements analysis processes to the inputs 4 by means of a computer program or a central program 8. The central program 8 analyzes the data and measurements originating from a plurality of pumping systems 2 in order to complete a function involving monitoring the whole of the pumping station 1. The monitoring system 7 further comprises a database consolidating together all the physical characteristics of the pumping systems 2 and of all their components. The monitoring system 7 is adapted to transmit instructions and commands to each pumping system 2 by means of each electrical cabinet 3. The electrical cabinet 3 adapts the instructions to the equipment to which said instructions are addressed, in order to convert them into a signal that can be interpreted by the equipment. The equipment can be the pump, the motor or a valve, for example. To this end, the electrical cabinet 3 can be configurable, in particular by means of a PLC (Programmable Logic Controller). The configuration of the electrical cabinet 3 allows this cabinet to be adapted to various pumping systems 2, comprising, for example, equipment originating from various manufacturers. The electrical cabinet 3 advantageously can be programmed by an electromechanical operator, who can enter thresholds and parameters to be taken into account in order to monitor and survey each pumping system 2 of the pumping station 1. Said thresholds and parameters thus can be adapted to each item of equipment. The thresholds and parameters can be transmitted to the monitoring system 7 and stored in the database. The central program 8 uses the characteristics of the pumping station 1, the measurements taken in real time, as well as the parameters and thresholds entered by the operator, in order to complete the monitoring function. The monitoring function involves analyzing all this information in order to detect a possible deviation, associated with an anomaly that can result in a breakdown or a malfunction of the pumping station 1. On detection of a deviation, the monitoring system 7 analyzes all the data in order to determine the cause of said deviation as a function of rules that are defined according to the practices in the field of managing pumping stations 1, as well as according to feedback from analyst experts on the causes of failures in pumping systems. These rules are also stored in the database. On the basis of the completed analyses, rules and detected anomalies, the central program 8 can determine one or more actions, either preventive or curative, to be taken. These actions can be automatically transmitted to the electrical cabinet 3 in the form of commands and transmitted to a human-machine interface 9 in order to be consulted by an operator. The operator can thus decide whether or not to carry out these actions or other operations. The operator can also, via the human-machine interface 9, enter commands to be implemented by the pumping station 1. The commands that can be implemented are, for example, shutting down the pump and the motor, opening or closing a valve of the pumping station, instructions for modifying the motor speed, etc.

Figure 2:
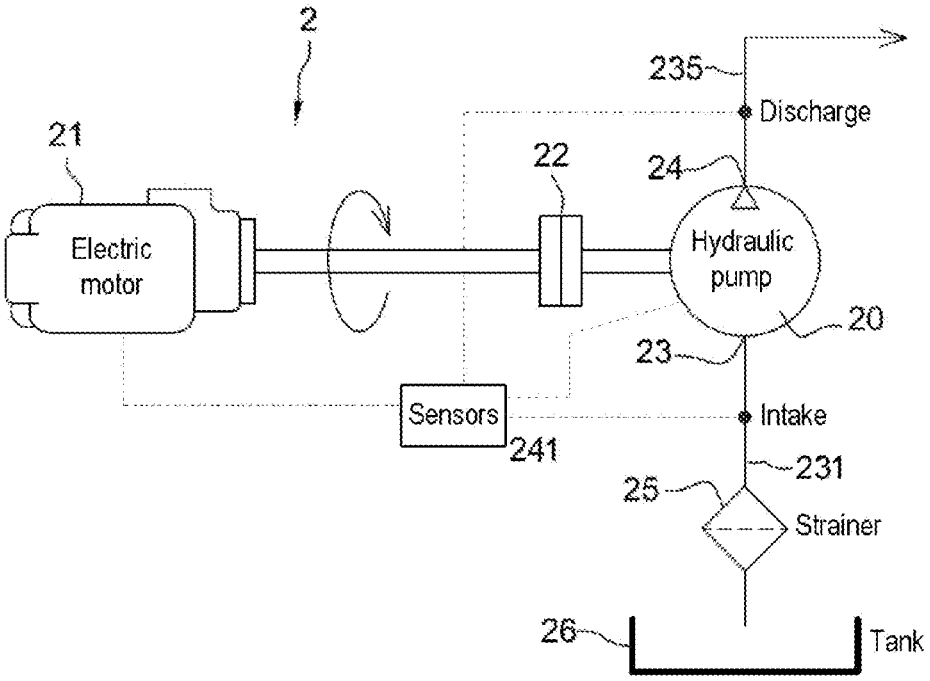
FIG. 2 depicts an example of a pumping system.

FIG. 2 depicts an example of a pumping system 2. The pumping system 2 comprises at least one pump 20, one motor 21, one device 22 for coupling the motor 21 with the pump 20.

The pump 20 is, for example, a dynamic pump that can be of the volumetric or rotodynamic type.

The motor can be an electric motor of the asynchronous type or even of the synchronous type with a permanent magnet or variable reluctance.

The pump 20 comprises a fluid inlet 23 via a suction or intake pipe 231 and a fluid outlet 24 via a discharge pipe. Therefore, the inlet 23 is connected to a suction pipe 231, which is connected to a water intake either through a strainer 25 or directly, without a strainer. The water suction can occur in a tank 26, for example. The outlet 24, connected to a discharge pipe 235, feeds a water transfer system, not shown. The water transfer system can comprise a pipe or a network of pipes with different diameters and lengths.

Alternatively, in an example that is not shown, the pump can be directly immersed in the liquid. In this case, the pumping system does not comprise a suction pipe.

Figure 3:
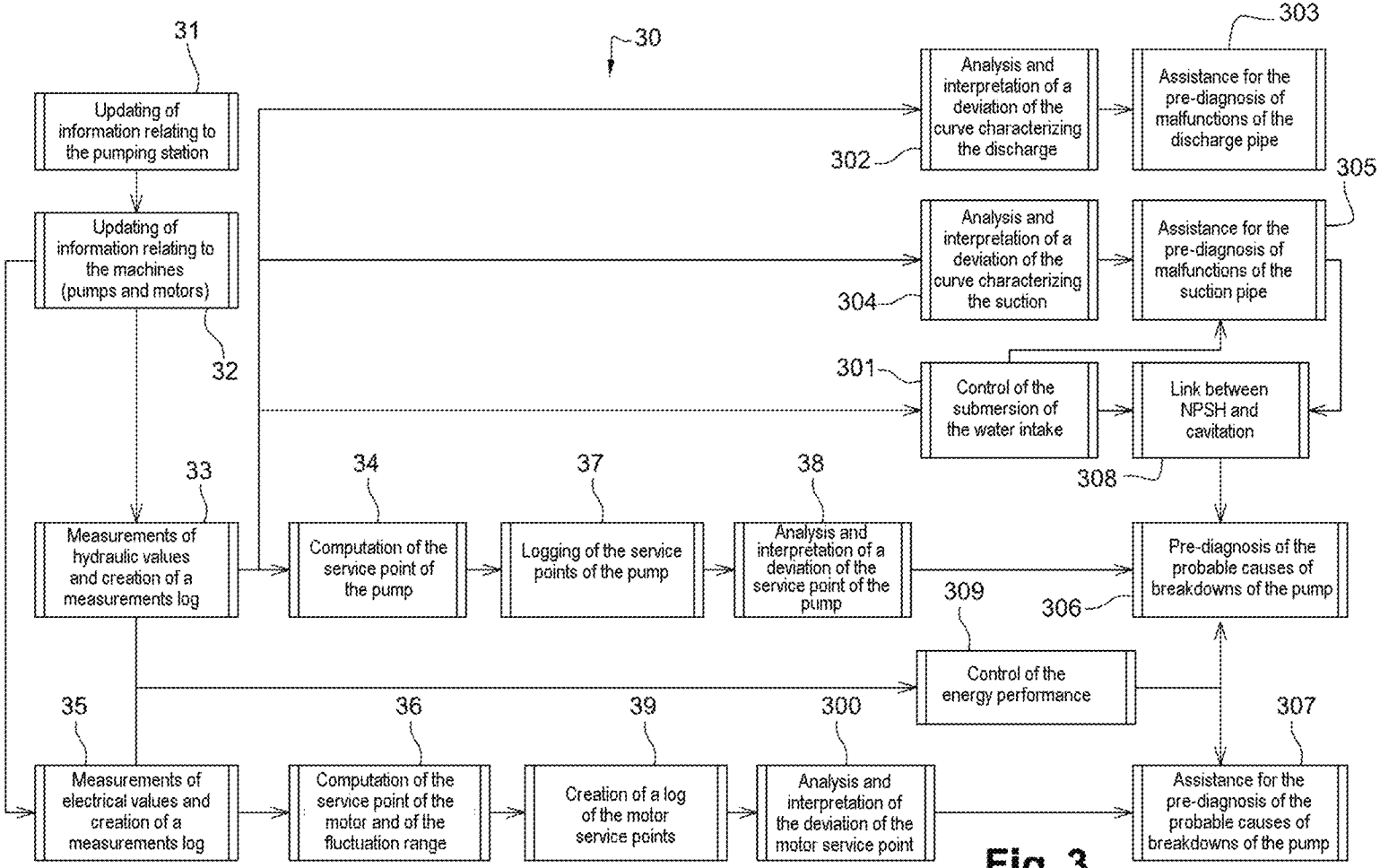
FIG. 3 depicts various possible steps of the method for keeping a pumping system according to the invention in operational condition.

FIG. 3 shows a plurality of steps of the method 30 according to the invention for keeping the pumping system 2 in operational condition. The method 30 according to the invention particularly comprises various steps of analyzing operation and of pre-diagnosing anomalies in the operation of the pumping system 2. The example that is described addresses a single pumping system, it can be reproduced in the same way for a pumping station 1 comprising more than one pumping system 2. The method according to the invention fulfils several functions:

- a function of monitoring the pumping station 1;
- a function of detecting an anomaly;
- a function of analyzing the detected anomalies;
- a function of pre-diagnosing anomalies allowing the probable causes of the anomalies to be determined;
- and, depending on the identified causes, a function of proposing actions to be taken, automatic generation of commands to be applied by the equipment of the pumping system 2.

A first step 31 of the method according to the invention is a step of updating the technical data and information relating to the pumping station, as well as to the water transfer system that it serves, in the database of the monitoring system 7. This information is, for example, the description of the pumping station 1 with all its elements. In particular, it is important to enter the characteristics of the non-visible parts of the pumping station 1, including their dimensions. Among the information describing the pumping station 1, it is also necessary to provide drawings and dimensions for locating the equipment of the pumping station 1 relative to each other and particularly the pump relative to the other equipment and the pump relative to the measuring, in particular hydraulic, instruments.

The information relating to the system served by the pumping station 1 involves physical characteristics of said served system, as well as of the various elements constituting the system. For example, the system served by the pumping station, or water transfer system, can comprise one or more pipes with different diameters and lengths. The information also includes a description of the modes for regulating the pumping station 1, which are defined to meet the requirements of the system served by the pumping station 1.

The various operating states of the pumping station can be included among the information: the normal operating modes, the exceptional operating modes, degraded or emergency, as well as the modes for regulating the pumping station 1 each associated with the operating modes of the system.

The information relating to the pumping station 1 allows a curve to be generated that characterizes the operation of the pumping station 1 and that depicts an evolution of the water flow rate output from the pumping station 1, as a function of the total manometric height.

A second step 32 of the method according to the invention is a step of updating the database with information relating to the equipments of the pumping station 1, in particular relating to the pump 20, the motor 21 and the discharge and suction pipes and the water intake. The information relating to the equipments includes the performance curves of the pumps and the motors.

The performance curves of the pump 20 are particularly the following curves:

- the hydraulic performance: total manometric height as a function of the flow rate of the pump;
- the hydraulic yield of the pump as a function of the flow rate of the pump;
- the mechanical power demanded from the pump on its shaft as a function of the flow rate;
- an NPSH (Net Positive Suction Head) required by the pump: i.e. the difference between the liquid pressure and the saturation vapor pressure at each point of the pump;
- the specific energy consumption of the pump.

The performance curves of the motor 21 are particularly as follows:

- the active power demanded as a function of the mechanical power delivered on the shaft of the motor;
- the yield of the motor;
- the movement power factor or cosine phi: the movement power factor represents the value of the angular phase shift between the voltage and the intensity of the current in the motor at the fundamental frequency (generally 50 or 60 Hz);
- the current intensity demanded as a function of the rotation speed of the motor shaft;
- the torque as a function of the rotation speed of the motor shaft;
- the rotation speed of the motor as a function of the mechanical power delivered on the motor shaft.

The first and second steps 31, 32 can be implemented on start-up of the pumping station 1, then each time the pumping station 1 or the system that it serves is modified, or even each time a component of the pumping station 1 is modified.

A third step 33 is a step of measuring or of computing physical values, and in particular hydraulic values, for characterizing the current operation of the pumping system 2. The third step is conducted periodically during the operation of the pumping station 1. The completed measurements are dated and progressively stored in the database of the monitoring system 7, with their date, thus forming a log. Each physical value is associated with an uncertainty and a range of variation of said value.

A first hydraulic value is a flow rate of the pump that can be measured directly or computed on the basis of other measurements.

A second measured hydraulic value is a geometrical height of the system provided by the pumping station 1, relative to said pumping station 1. This geometrical height represents a minimum incline that the pump has to overcome in order to feed the system that it serves.

A third hydraulic value is a total manometric height or TMH. The manometric height can be defined as the sum of the geometrical height and of the load losses at the suction and discharge point of the pump.

A fourth hydraulic value is a total dynamic height. The total dynamic height, or TDH, can be defined as the sum of the total manometric height and of the dynamic pressure difference between the inlet and the outlet of the pump.

Mechanical values also can be taken into account, such as vibration levels.

A fourth step 34 is a step of computing a service point or operating point, which is characteristic of the operation of the pump at a given instant. The service point is determined on the basis of the hydraulic values computed or measured during operation. The service point can be defined at a given instant by a flow rate and a total manometric height.

A fifth step 35 is a step of computing physical values, in particular electrical and mechanical values.

The measured electrical values are the intensity of the current demanded from the motor 21 and the power supply voltage of the motor, as well as the range of variation of these two electrical values.

The fifth step 35 is also a step of determining powers: active, reactive, apparent, deforming and their ranges of variation. The uncertainties of the computations of the various powers are also determined.

The active power can be defined as the power required for the drive machine to work.

The reactive power is defined as being the power required to operate the machine, in this case the pump 20.

The apparent power is defined as being the power that actually circulates in the equipment.

The deformation power is a fourth power, present in the circuits comprising electronic components that generate non-linear and therefore harmonic loads. The deformation power is the power used by the harmonic component.

The fifth step 35 involves determining various power factors, i.e. the cosine phi, the total power factor and the rate of total harmonic distortion, as well as the uncertainties on the various power factors.

The rate of total harmonic distortion is also denoted distortion power factor.

The fifth step 35 is cyclically implemented during the operation of the pumping system 2. The measurements and the results of the computations of these electrical values are stored in the database with a date and their measurement or computation uncertainty, as well as their range of variation, in order to form a log.

A sixth step 36 is a step of determining a service point of the motor and its range of fluctuation.

The sixth step 36 comprises a step of determining an operating range of the motor located in the vicinity of an operating or nominal service point.

A nominal service point of a motor is the service point that it is built to operate at during its design stage.

The nominal service point rarely coincides with an actual service point. The service point of the motor is defined as the point of equilibrium between the drive torque developed by the motor and the resistive torque opposed by the load machine.

The operating range around the service point is defined as a function of the measurements taken on the current and the torque and as a function of their range of variation around the nominal service point.

The sixth step 36 comprises a step of estimating the yield of the motor and its range of variation at the service point. The yield of the motor is estimated on the basis of the measurements of the following physical values:

active demanded electrical power;

demanded current intensity;

power supply voltage of the motor.

The yield of the motor is also estimated on the basis of an estimate of the mechanical power absorbed by the pump on its drive shaft.

Figure 4:
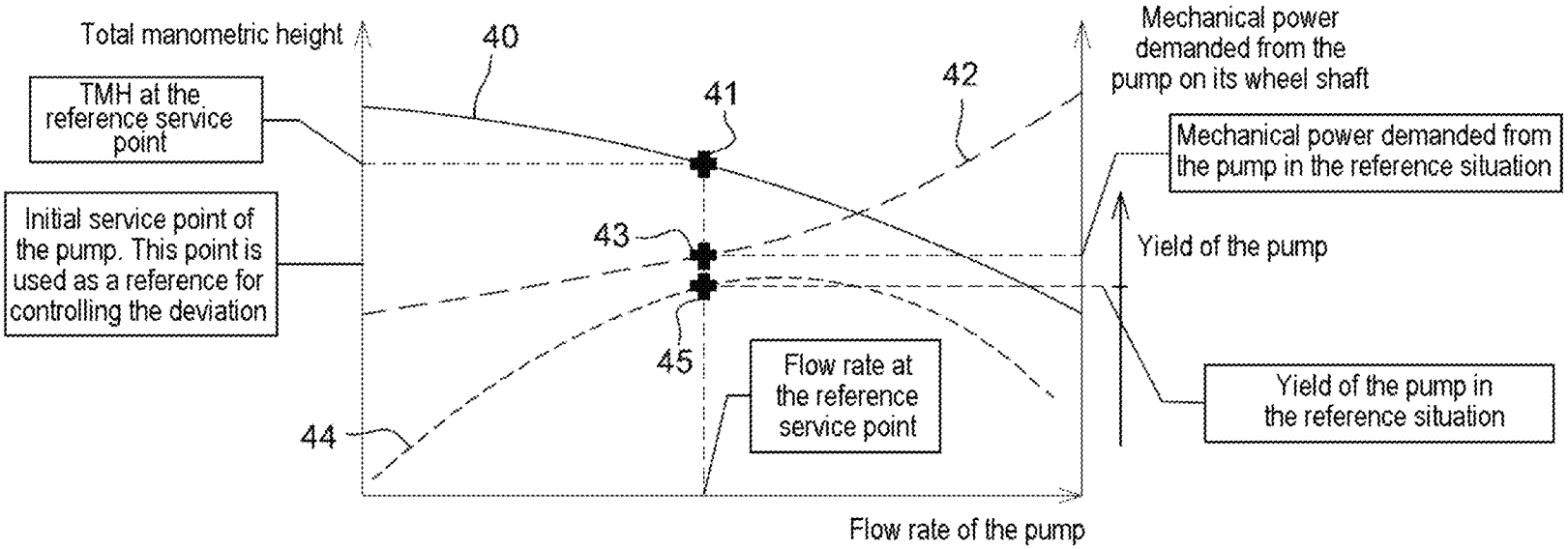
FIG. 4 depicts operating curves of a pump of a pumping system.

A seventh step 37 is a step of creating a log of the service points determined during the operation of the pump. The creation of a log involves storing the various service points in the database of the monitoring system 7 in order to be able to follow the evolution. FIG. 4 describes the data required to describe a reference situation for operating the pump. This reference situation will allow the behavior of the pump to be analyzed by following the movement of the service point relative to the reference service point, in the reference situation.

FIG. 4 depicts examples of performance curves of a pump. The performance curves of the pump are particularly established on the basis of the data supplied by the pump manufacturer. A reference situation is determined, either on the basis of the measured and computed data, or on the basis of the data supplied by the manufacturer to characterize nominal operation of the pump.

FIG. 4 depicts a first performance curve 40 of the pump in nominal operation. The first curve 40 represents a flow rate of the pump as a function of a total manometric height. On the first curve 40, a first initial service point 41 corresponds to a reference service point. The reference service point 41 is obtained by determining the flow rate of the pump as a function of the total manometric height in a reference configuration of the pumping station 1 and of the system that it serves.

FIG. 4 also depicts a second performance curve 42 representing the mechanical power demanded from the pump on its wheel shaft as a function of the flow rate of the pump. A second reference service point 43 can be defined as a function of the reference mechanical power at the reference flow rate.

A third performance curve 44 can be defined on the basis of the yield of the pump as a function of the flow rate of the pump. A third reference point 45 can be defined as the yield of the pump in the reference situation at the reference flow rate.

Thus, it is possible to analyze the operation of the pump during an eighth step 38. The eighth step 38 is a step of comparing the current operating point of the pump with the corresponding performance curve of the pump and thus of identifying a possible deviation in the operating point relative to the performance curve of the pump and relative to the first previously defined reference service point 41.

Figure 5:
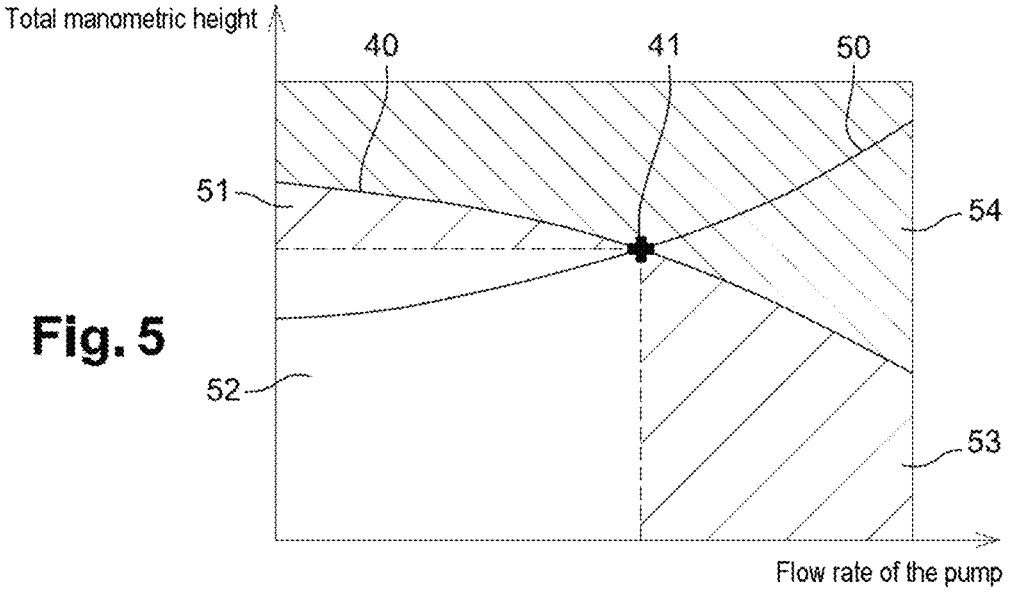
FIG. 5 depicts an analysis diagram of the operation of a pump according to the invention.

Depending on the evolution of the trend of the deviation, it is possible to interpret the probable causes of this deviation, as shown in FIG. 5, and to detect a possible operating anomaly.

FIG. 5 depicts a division of the two-dimensional space into zones defined by the flow rate of the pump and the total manometric height. The division into zones uses the first performance curve of the pump 40, as well as the first reference service point 41. FIG. 5 also depicts the characteristic curve 50 of the pumping station 1.

A first zone 51 is positioned under the first performance curve 40 of the pump and above a line at a constant nanometric height equaling the nanometric height of the first reference service point 41. The first zone 51 is referred to as the zone for increasing the TMH and for reducing the flow rate of the pump.

A second zone 52 is defined for all the operating points for which the total manometric height is below the manometric height of the first reference service point 41 and therefore for a pump flow rate that is below the flow rate of the pump at the first reference point 41. The second zone 52 is referred to as the zone for reducing the TMH and for reducing the flow rate of the pump.

A third zone 53 is defined below the performance curve 40 of the pump, for the service points for which the flow rate is greater than the flow rate of the pump at the first reference point 41. The third zone 53 is referred to as the zone for reducing the TMH and for increasing the flow rate.

A fourth zone 54 is defined for all the operating points above the characteristic curve of the pumping station. The fourth zone 54 is referred to as the performance increasing zone.

Depending on the position of the current service point in one of these zones or on the performance curve 40 of the pump or even on the performance curve 50 of the pumping station, a different analysis, providing different interpretations to the deviation, is undertaken. For example, a deviation of the service point of the pump in the fourth zone 54 can mean that the diameter of the pump wheel has been modified and particularly increased, or that the rotation speed has increased, or both. One preventive action to be taken then can involve updating the characteristics of the pump in the database.

By way of another example: if the service point deviates on the performance curve of the pump, this can mean that the discharge, or distribution network downstream of the pump, is clogging up in the case of a drinking water distribution pump. Another interpretation can be that the borehole is clogging up in the case of a borehole pump. Clearly, the phenomena can be combined. This can also reveal a leak in the discharge pipes or in the water distribution network. It is also possible that there has been a dimensional change, causing the geometrical height of the pumping station to be modified. It will then be recommended that the pumping station, the pipes and the systems upstream and downstream of the pump 20 are verified.

Furthermore, in order to confirm or deny this pre-diagnosis, it may be advisable, as a preventive measure, to check the relationship between the discharge pressure and the flow rate, to monitor any damage on the pipes of the system served by the pumping station 1 and the modifications made on the pumping station 1, in order to update the characteristics of the pumping station 1 in the database.

The ninth step 39 is a step of creating a log of the different service points of the motor, determined during the operation of the pumping station 1. The evolution of the service point of the motor is assessed on the basis of a reference situation, as depicted in FIG. 6.

Figure 6:
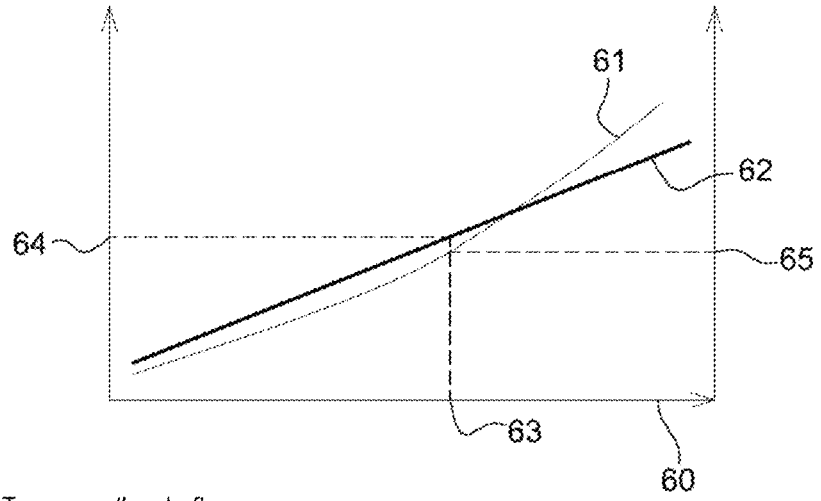
FIG. 6 depicts operating curves of a motor of a pumping system.

FIG. 6 illustrates a reference situation that can be used to analyze any deviations of the service point of a motor 21.

In FIG. 6, the abscissa axis depicts the mechanical power of the motor.

A first curve 61 depicts the intensity of the demanded electric current. A second curve 62 depicts the active demanded electric power. A reference service point is defined on each curve 61, 62 for a mechanical power 63 delivered by the motor in the reference situation. It is thus possible to determine a demanded intensity for the reference service point 64. Subsequently, it is also possible to determine an active demanded electric power 65 for the reference service point, for the mechanical power delivered by the motor at the reference service point.

Other trend curves can be used, such as the temperature of the motor as a function of the intensity of the current or the temperature of the motor as a function of the active power, in order to describe the reference situation for monitoring the operation of the motor 21.

The tenth step 300 is a step of analyzing a possible deviation of the service point of the motor 21 and an interpretation of the deviation if it is observed, in order to detect a possible operating anomaly. The analysis is based on an interpretation of the load of the motor, as depicted in FIG. 7.

Figure 7:
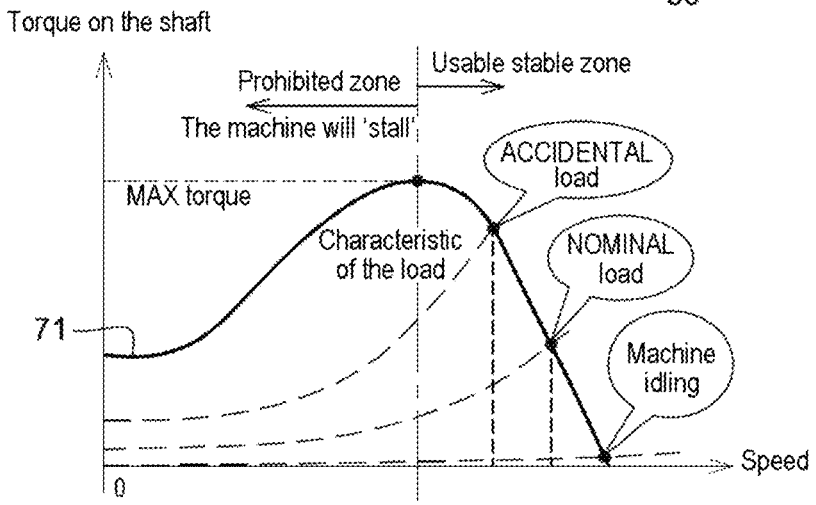
FIG. 7 depicts load curves of the motor.

FIG. 7 depicts different load curves on the motor shaft as a function of the rotation speed of the motor shaft. A maximum torque is defined that allows a maximum torque speed to be defined, below which the machine is at risk of stalling. Above this maximum torque speed, the motor 21 is in a stable operating zone. In this stable operating zone, or usable stable zone, three curves are defined characterizing different loads of the motor. A first load curve describes the accidental operating load of the motor, or accidental load. A second load curve describes the nominal load. A third load curve describes the load of the motor when the machine is idling. The intersection of these load curves with a curve for defining the evolution of the torque of the motor as a function of its speed 71 provides the speeds corresponding to each type of load, accidental, nominal or idle.

When the pump wheel rotates without propelling liquid, which can be the case with a clogged wheel or a de-energized pump, the wheel does not generate hydraulic power. The motor then drives a free wheel and does not need much electric power. The motor torque drops below the torque at the nominal load. In this case, it is worthwhile combining the demanded intensity and the motor torque and defining a low threshold value for the demanded intensity corresponding, for example, to 95% of the average intensity at the nominal load. If the low threshold is exceeded and the motor enters a range where it runs idle, or at a low load, then the operation of the pump and of its motor needs to be stopped. One possible interpretation is that air has entered the pump. The motor and the pump can be automatically shutdown by the electrical cabinet 3 of the pumping system 2.

When the pump wheel rotates but its rotation is braked, for example: in the event of mechanical clearances that are clogged with debris, in the event of clogging through concretions, if the stop on a borehole pump starts to seize up, then the pump wheel generates enough hydraulic power to provide the expected service, but the electric motor delivers, on the one hand, the mechanical power that is converted into hydraulic power and, on the other hand, extra mechanical power that allows the braking experienced by the wheel to be compensated. The motor torque increases above the torque at the nominal load and transitions to accidental load. In this case, it is also advisable for the analysis of the demanded intensity to be linked, by defining an upper threshold, beyond which the motor is considered to be operating overloaded. Exceeding the upper threshold associated with a motor torque corresponding to an accidental load requires the shutdown of the pump and of the motor, as a curative measure. This shutdown can be implemented by the device for managing the pumping system, comprising the electrical cabinet 3 and the monitoring system 7.

Another operating anomaly can be detected by an increase in the active power and a simultaneous loss of TMH. The active electric power demanded from the motor increases when the suction of the pump is constricted, since it is placed in a situation comparable to that of an NPSH test. At a certain point of the constriction of the suction, the total manometric height that can be produced by the pump drops and, at the same time, the yield of the motor drops and the active electric power increases. It is then proposed for an upper threshold to be set for the active power demanded from the motor of the pump. By way of an example, this threshold can be placed between 102% and 105% of the average active electric power at the service point furthest to the right of the service range of the pump on the pump performance curve. The following trend curves also need to be verified:

absolute pressure provided as a function of time for a given flow rate;

TMH as a function of time;

active electric power as a function of time;

motor temperature as a function of time.

An increase in the active electric power concurrent with a drop in the TMH and a drop in the suction pressure means that the intake of the pump clogs up and that the pump cavitates. The increase in the temperature of the motor indicates the imminent threat of overheating of the windings, or coils, of the motor. The pump needs to be stopped immediately and the pump intake needs to be carefully inspected, i.e. the strainer 25, the pipes, the water intake, etc.

The eleventh step 301 is a step of controlling the submersion of the water intake of the pump. This step requires the following measured physical values:

a water height in a suction tarp or in the water intake of the pump;

a flow rate sucked in by the pump on the water intake;

the geometry, or physical description of the water intake according to the following parameters: diameter, position in the water intake or in the intake tarp.

In order to analyze the evolution of the submersion, the following computations need to be completed:

compute the average speed of the flow, then the Froude number of the flow in the inlet section of the suction pipe and the ratio between the submersion and the diameter of the inlet section of the suction pipe provided as a function of the Froude number (see the submersion condition of the orifice of the suction pipe according to J. Knauss and the submersion condition of the orifice of the suction pipe according to the Hydraulic Institute);

by knowing the ratio between the submersion and the diameter of the inlet section of the suction pipe, the value of the submersion can be computed.

The analysis of the submersion computed while particularly taking into account the thickness of the water column in the water intake makes it possible to determine whether a turbulent flow disrupts the velocity field at the pump inlet and if it causes air to enter the pump, which could de-energize the pump or at the very least generate vibrations in the pump. In this case, the water level needs to be raised above the water intake, for example, by reducing the flow rate of the pump or by shutting down the pump as a curative measure.

A twelfth step 302, 303 can be a step 302 of analyzing a curve characterizing the discharge and a step 302 of interpreting and of pre-diagnosing 303 a possible deviation using the following measured or computed physical values:

discharge pressure of the pump;

flow rate governed by the pump;

intensity demanded from the motor;

active power demanded from the motor.

The analysis is also based on the temporal evolution of the discharge pressure relative to the flow rate governed by the pump.

It is also possible to take into account mechanical values, such as vibration levels.

Several indicators can be monitored in order to detect an issue involving blocking of the discharge pipe. A first indicator is the service flow rate that circulates in the discharge pipe. Indeed, a loss of flow rate results in a reduction in the diameter of the discharge pipe. Depending on the determined reduction in the diameter, the pipe may need to be cleaned as a curative measure. Another indicator can be a ratio between the service flow rate of the pump and the flow rate at a best yield point of the pump determined on the performance curve of the yield of the pump.

The loss of flow rate of the pump associated with the loss of flow rate of the pipe also can be analyzed in order to take steps for cleaning the discharge pipe.

The thirteenth step 304, 305 is a step 304 of analyzing a possible deviation of the curve characterizing the suction, a step of interpreting this deviation, then a pre-diagnosis 305 of a malfunction of the suction pipe upon detection of an anomaly. The thirteenth step 304, 305 is optional for submersed pumps, i.e. those that are not connected to a water intake by means of a suction pipe.

The measured physical values that are taken into account for the thirteenth step 304, 305 are as follows:

suction pressure of the pump;

flow rate governed by the pump;

intensity demanded from the motor;

active power demanded from the motor.

The computed physical values that are taken into account are as follows:

the evolution curve of the suction pressure, measured by absolute pressure, as a function of the flow rate governed by the pump over time;

the evolution curve of the available NPSH or even the suction pressure expressed as absolute pressure, as a function of time;

the evolution curve of the TMH as a function of the flow rate governed by the pump, over time;

the active power demanded from the motor as a function of the flow rate governed by the pump over time.

It is also possible to take into account mechanical values, such as vibration levels.

The analysis and monitoring of the NPSH, of the service flow rate that circulates in the suction pipe and the ratio between the service flow rate and the flow rate at the best yield point allow a reduction in the diameter of the pipe, a loss of flow rate on the pump and a loss of flow rate on the pipe to be detected, which can result in actions being taken to clean the pump.

The fourteenth step 306 is a step of pre-diagnosing probable causes of malfunctions of the pump. This step is a step allowing several indicators of hydraulic failures to be associated with possible hydraulic causes of these failures. The indicators considered for this pre-diagnosis step are derived from previously completed analyses. These indicators are the following operating conditions: lack of flow rate, insufficient flow rate, insufficient pressure, intermittent flow rate. The possible causes are, for example, "the pump is not primed or loses its priming" when all the aforementioned operating conditions are met, or even "excessive air is trapped in the pumped liquid", a lack of flow rate alone can indicate a "clogged wheel", an insufficient flow rate alone can indicate an incorrect direction of rotation of the pump wheel, etc.

The fifteenth step 307 is a step of assisting the pre-diagnosis of the probable causes of motor breakdowns. In particular, this step allows the probable mechanical causes of these failures to be traced from a list of failures. The identified failures can be as follows, for example:

the bearings are hot or breakdown very regularly;

the breakdowns on the seals are very frequent;

the motor braids have a short lifetime;

the pump vibrates above permissible levels;

the pump demands excessive power on the shaft;

the wear of wet parts inside the motor is faster than normal.

For example, if the only identified failure is "the bearings are hot or breakdown very regularly", then the probable cause can be improper cooling of the lubricant or even an axial or radial load that is greater than the design loads of the motor bearings. By way of another example, a single failure of the type termed "the breakdowns on the seals are very frequent" can be associated with overheating of the friction faces of the seal or a lack of leaching water on the friction faces of the seal or even incorrect assembly of the seal, etc.

A sixteenth step 308 is a step allowing a connection to be established between the evolution of an NPSH and the phenomenon of cavitation of the pump in order to detect this cavitation. The measured physical values required to establish this connection are as follows:

for the pump: suction pressure, discharge pressure, flow rate;

for the motor: active electric power, temperature of the windings.

The computed physical values that are taken into account are as follows:

for the pump: total manometric height, service point and its range of variation (flow rate-total manometric height pair);

for the pumping station: available NPSH of the pumping station in the range of variation of the service point of the pump.

The available NPSH depends on the suction circuit and on the suction flow rate, whereas the NPSH required by the pump depends on the pump and the flow rate that it delivers. For a given suction circuit and pump, a maximum permissible flow rate exists, beyond which the NPSH required by the pump exceeds the NPSH available in the suction circuit. If the flow rate at the service point exceeds this maximum permissible flow rate, the pump can be the source of the cavitation phenomenon that is likely to damage the pump: indeed, the cavitation exposes the pump to erosion, which can destroy the pump wheel and lead to the replacement of the pump, in particular with another type of pump better adapted to the operating conditions. The appearance of this phenomenon can be a sign of the fact that the pump that is used is not adapted to the requested service.

A seventeenth step 308 is a step of controlling the energy performance of the pumping unit.

By creating a difference between the monitoring of the overall yield of the pumping system and the reference curve thereof, if a downward trend is identified, this can be due to overall wear of the pumping system.

The wear of the pumping system also can be detected by monitoring the specific energy consumption of the pumping system and in particular if an upward statistical difference is revealed.

Advantageously, the device and the method according to the invention enable the earliest possible detection of any anomalies in the operation of the pumping station and preventive or curative actions to be implemented in order to avoid or to minimize the consequences of anomalies with respect to the operation or the integrity of the pumping system. Thus, the pumping system is kept in an operational state, i.e. in a good state of operation, in an efficient and inexpensive manner.

The various embodiments of the present invention comprise various steps. These steps can be implemented by machine instructions that can be executed by means of a microprocessor, for example.

Alternatively, the steps can be completed by specific integrated circuits comprising wired logic for executing the steps, or by any combination of programmable components and customized components.

The present invention also can be provided in the form of a computer program product, which can comprise a non-transitory computer memory medium containing instructions that can be executed on a computer machine, these instructions can be used to program a computer (or any other electronic device) for executing the method.

The invention claimed is:

1. A method for maintaining a pumping system (2) of a pumping station (1) in operational condition (30), said pumping system (2) equipped with a pump (20), a motor (21) driving the pump (20), a discharge pipe for discharging fluid via the pump (20), and a suction pipe for sucking in fluid via the pump (20), said method comprising at least the following steps:

measuring physical values characterizing the operation of the pumping system (2), including physical values characterizing a state of the discharge pipe of the pump (20) and a state of the suction pipe of the pump (20);

analyzing and interpreting the measured physical values in order to detect one or more anomalies;

pre-diagnosing probable causes of the detected anomalies, and determining preventive and curative actions to be undertaken on the pumping system (2);

automatically implementing preventive and curative actions on the pumping system (2);

analyzing and interpreting curves characterizing operation of the suction and discharge pipes of the pump (20); and controlling submersion of a water intake at the inlet of the pumping system (2), said step of analyzing and interpreting curves characterizing the operation of the discharge pipe of the pump, taking into account an evolution of the following parameters over time, which are measured or computed values:

a discharge pressure of the pump, a flow rate governed by the pump, a current intensity demanded from the motor, and an active power demanded from the motor, and said step of analyzing and interpreting curves being also based on a temporal evolution of the discharge pressure relative to the flow rate governed by the pump, the step of analyzing and interpreting leading to a detection of whether the discharge pipe is blocked, wherein if the discharge pipe is blocked, the method further comprises steps for cleaning the discharge pipe.

2. The method as claimed in claim 1, further comprising:

analyzing and interpreting an evolution of operating points (38) of the pump (20); and analyzing and interpreting an evolution of operating points of the motor (300).

3. The method as claimed in claim 1, further comprising:

monitoring a specific energy consumption of the pumping system (2), wherein the pre-diagnosis identifies wear as a probable cause where an upward statistical difference is detected in said specific energy consumption.

4. The method as claimed in claim 1, further comprising:

detecting a cavitation phenomenon.

5. The method as claimed in claim 3, wherein the step (301) of controlling the submersion of the water intake at the inlet of the pumping system (2) takes into account a water height in the water intake, a flow rate sucked in by the pump (20) at the water intake, and physical description parameters of the water intake.

6. The method as claimed in claim 1, wherein the step (304) of analyzing and interpreting the operation of the suction pipe takes into account an evolution of the following parameters over time: a suction pressure of the pump, the flow rate governed by the pump, the current intensity demanded from the motor (21), the active power demanded from the motor (21), a total manometric height, and a Net Positive Suction Head (NPSH) defined as a difference between a liquid pressure and a saturation vapor pressure at each point of the pump.

7. The method as claimed in claim 2, further comprising:

monitoring a specific energy consumption of the pumping system (2), wherein the pre-diagnosis identifies wear as a probable cause where an upward statistical difference is detected in said specific energy consumption.

8. The method as claimed in claim 2, further comprising: detecting a cavitation phenomenon.

9. The method as claimed in claim 3, further comprising: detecting a cavitation phenomenon.

10. The method as claimed in claim 3, wherein the step (301) of controlling the submersion of the water intake at the inlet of the pumping system (2) takes into account a water height in the water intake, a flow rate sucked in by the pump (20) at the water intake, and physical description parameters of the water intake.

11. The method as claimed in claim 4, wherein the step (301) of controlling the submersion of the water intake at the inlet of the pumping system (2) takes into account a water height in the water intake, a flow rate sucked in by the pump (20) at the water intake, and physical description parameters of the water intake.

12. The method as claimed in claim 2, wherein the step (304) of analyzing and interpreting the operation of the suction pipe takes into account an evolution of the following parameters over time: a suction pressure of the pump, the flow rate governed by the pump, the current intensity demanded from the motor (21), the active power demanded from the motor (21), a total manometric height, and a Net Positive Suction Head (NPSH) defined as a difference between a liquid pressure and a saturation vapor pressure at each point of the pump.

13. A device for maintaining a pumping system (2) of a pumping station (1) in operational condition, said pumping system (2) equipped with a pump (20), a motor (21) driving the pump (20), a discharge pipe for discharging fluid via the pump (20), and a suction pipe for sucking in fluid via the pump (20), said device comprising:

first sensors configured to acquire first measurements of hydraulic and mechanical values of the pump (20), the discharge pipe, the suction pipe, said first measurements comprising a total manometric height as a function of a flow rate of the pump, a hydraulic yield of the pump as a function of the flow rate of the pump, a mechanical power demanded from the pump on a shaft of the pump as a function of the flow rate, a specific energy consumption of the pump, and a Net Positive Suction Head (NPSH) defined as a difference between a liquid pressure and a saturation vapor pressure at each point of the pump;

second sensors configured to acquire second measurements of electrical and mechanical values of the motor (21), said second measurements comprising an active power demanded as a function of a mechanical power delivered on a shaft of the motor, a yield of the motor, a movement power factor representing a value of an angular phase shift between a voltage and an intensity of a current in the motor at a fundamental frequency, a current intensity demanded as a function of a rotation speed of the motor shaft, a torque as a function of the rotation speed of the motor shaft, and a rotation speed of the motor as a function of the mechanical power delivered on the shaft of the motor;

an electrical cabinet (3) configured to collect the first and second measurements from the first and second sensors, and to transmit operating instructions to said pumping system (2); and a monitoring system (7) comprising a computer and a human-machine interface, the computer in communication with the first and second sensors and configured to execute a central program (8) configured to cause the computer to:

measure physical values characterizing the operation of the pumping system (2), including physical values characterizing a state of the discharge pipe of the pump (20) and a state of the suction pipe of the pump (20), analyze and interpret the measured physical values in order to detect one or more anomalies, pre-diagnose probable causes of the detected anomalies, and determine dctcrmining preventive and curative actions to be undertaken on the pumping system (2), and automatically transmit commands to the electrical cabinet (3) as a function of the detected anomalies, the pre-diagnosed probable causes, and the determined preventive and curative actions, and display results of the detected anomalies, and the pre-diagnosed probable causes, and the determined preventive and curative actions on the human-machine interface.

* * * * *